US011226113B2

(12) United States Patent
Hunter

(10) Patent No.: US 11,226,113 B2
(45) Date of Patent: Jan. 18, 2022

(54) AIR CONDITIONING SYSTEM

(71) Applicant: Haier US Appliance Solutions, Inc., Wilmington, DE (US)

(72) Inventor: Kyle Hunter, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 101 days.

(21) Appl. No.: 16/540,138

(22) Filed: Aug. 14, 2019

(65) Prior Publication Data

US 2021/0048202 A1 Feb. 18, 2021

(51) Int. Cl.
*F24F 1/027* (2019.01)
*F24F 1/031* (2019.01)

(52) U.S. Cl.
CPC ..... *F24F 1/027* (2013.01); *F24F 1/031* (2019.02)

(58) Field of Classification Search
CPC .... F24F 1/031; F24F 1/027; F24F 1/54; F24F 1/06; F24F 1/52; F24F 1/62
See application file for complete search history.

(56) References Cited

U.S. PATENT DOCUMENTS 4,733,543 A 3/1988 Blair
10,488,083 B2 * 11/2019 Eicher ..... F24F 3/1405
2007/0221302 A1 * 9/2007 Boone ..... F24F 13/20 150/165
2015/0345842 A1 * 12/2015 Kawano ..... F24F 3/08 62/196.1
2018/0142906 A1 * 5/2018 Wu ..... F24F 1/027
2019/0107296 A1 * 4/2019 Clark ..... F24F 11/56

FOREIGN PATENT DOCUMENTS

CN 2370319 Y 3/2000
CN 109028349 A * 12/2018
JP H03213928 A 9/1991

OTHER PUBLICATIONS

CN109028349A Translation (Year: 2018).*

* cited by examiner

*Primary Examiner* — Schyler S Sanks
(74) *Attorney, Agent, or Firm* — Dority & Manning, P.A.

(57) ABSTRACT

An air conditioning system and a method of installing the same are provided. In one aspect, an air conditioning system includes an indoor unit and an outdoor unit. The indoor unit is a split-system indoor unit that includes an indoor coil and an indoor fan for moving air over the indoor coil to condition a designated space. The outdoor unit is positioned within an opening defined by an exterior wall and includes an outdoor coil and an outdoor fan for moving air over the outdoor coil. The indoor coil of the indoor unit and the outdoor coil of the outdoor unit are fluidly coupled such that a sealed system is formed between the indoor and outdoor units. The outdoor unit can be a revamped packaged terminal air conditioner (PTAC) with the indoor sealed components removed therefrom. A streamlined sleeve cover can be connected to a sleeve of the revamped PTAC.

17 Claims, 4 Drawing Sheets

AIR CONDITIONING SYSTEM

FIELD OF THE INVENTION

The subject matter of the present disclosure relates generally to air conditioning systems.

BACKGROUND OF THE INVENTION

Mini-split or split air conditioning systems allow for temperature control in individual rooms or spaces, such as condominiums, apartments, and hotel rooms. Mini-split systems typically include two main components, including an outdoor unit (compressor/condenser) and an indoor or air-handling unit (evaporator). The outdoor unit and the indoor unit are typically in fluid communication via refrigerant lines and in electrical communication via one or more electric lines.

Conventionally, installation of a mini-split system has presented many challenges with respect to placement of the outdoor unit. One current solution is to place the outdoor unit on the roof of the building and to run the refrigerant lines from the indoor unit to the outdoor unit. While this solution avoids the potential eye sore of having the outdoor unit placed along the side of the building, many current mini-split systems are limited in their maximum vertical lift, which limits mini-split systems to low-rise building installations. Another current solution is to mount the outdoor unit to the exterior of the building. This, however, can create a major eye sore for the building. In addition, outdoor units can be difficult to access for maintenance purposes, particularly if the outdoor unit is mounted along the side of the building. Moreover, conventionally, outdoor units have not been accessible from inside the room where the indoor unit is located; thus, a maintenance professional must move between indoor and outdoor locations to service the indoor and outdoor units, respectively. This can be inconvenient to maintenance professionals.

Accordingly, improved systems that address one or more of the challenges noted above would be useful.

BRIEF DESCRIPTION OF THE INVENTION

Aspects and advantages of embodiments of the present disclosure will be set forth in part in the following description, or may be learned from the description, or may be learned through practice of the embodiments.

In one aspect, an air conditioning system is provided. The air conditioning system includes an indoor unit operable to move conditioned air into a space. The indoor unit has an indoor coil. Further, air conditioning system includes an outdoor unit mounted within an opening defined by an exterior wall. The outdoor unit has an outdoor coil in fluid communication with the indoor coil of the indoor unit.

In some embodiments, the outdoor unit is a revamped PTAC unit. The revamped PTAC unit can revamped in that the indoor sealed system components of the existing PTAC unit are removed or otherwise disconnected from the outdoor sealed system components of the PTAC unit. The outdoor sealed system components of the PTAC unit are fluidly coupled with indoor sealed system components of an indoor split-system unit. In this way, the revamped PTAC and the indoor split-system unit form a sealed system. A streamlined sleeve cover can be connected to the existing sleeve of the revamped PTAC.

In another aspect, a method of installing an air conditioning system is provided. The method includes fluidly coupling an indoor coil of an indoor unit operable to condition a space with an outdoor coil of an outdoor unit mounted within an opening of a wall.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION OF THE INVENTION

Figure 1:
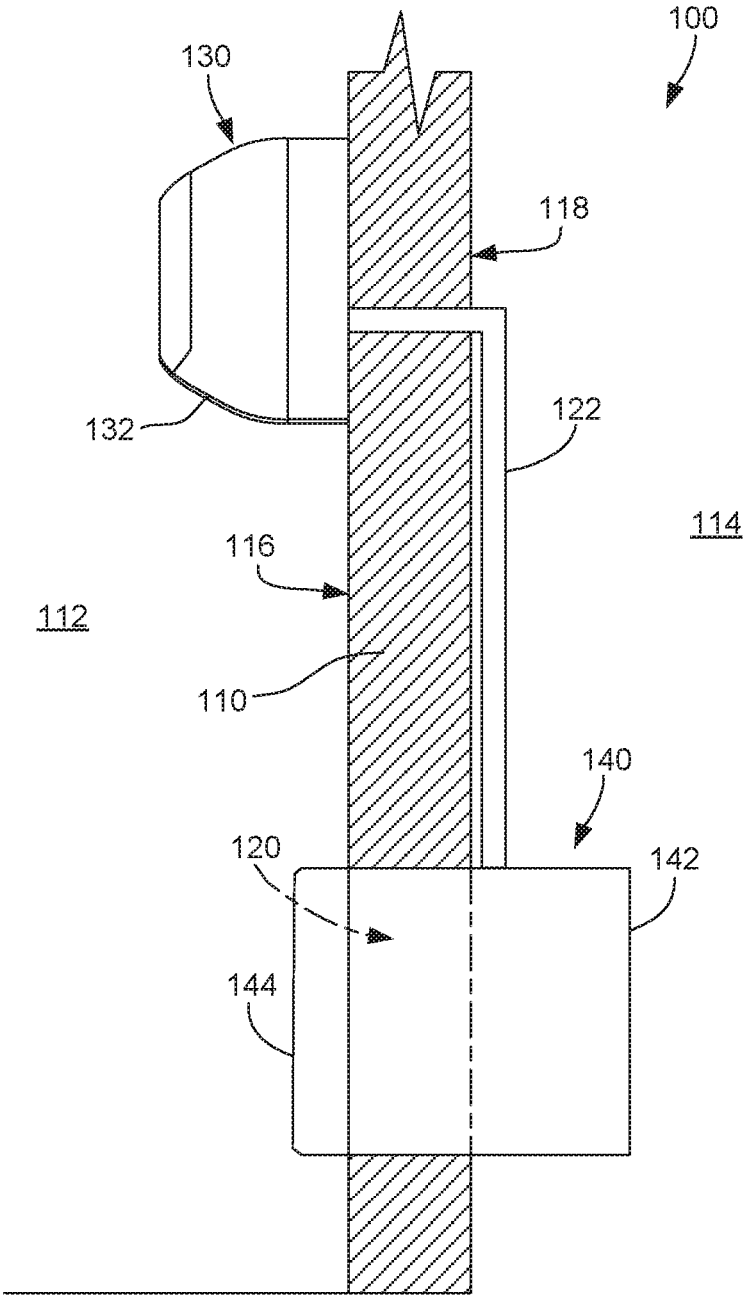
FIG. 1 provides a schematic side view of an exemplary air conditioning system according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

It is noted that, for the purposes of the present disclosure, the terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

FIG. 1 provides a schematic side view of an air conditioning system 100 according to an exemplary embodiment of the present disclosure. For this embodiment, air conditioning system 100 is a heat pump system operable to heat or cool a designated space depending on whether system 100 is operating in a cooling mode or a heating mode. Although system 100 is described herein a heat pump system, it will be appreciated that the inventive aspects of the present subject matter can be applied to systems that only have cooling or heating capabilities. As will be explained herein, system 100 leverages the benefits of a mini-split system and a packaged terminal air conditioner (PTAC) to create a hybrid air conditioning system. Particularly, system 100 employs an indoor unit of a mini-split system to handle the air within a designated space in a more quiet manner than a standard PTAC and utilizes a sleeve of a new or existing PTAC that is positioned within an opening of an exterior wall to provide maintenance access to the outdoor unit from indoors while alleviating the aesthetically displeasing and limiting problems associated with outdoor units of conventional mini-split systems.

As depicted in FIG. 1, an exterior wall 110, e.g., of a building, separates an indoor space 112 from an exterior or outdoor space 114. Exterior wall 110 has an indoor side 116 and an outdoor side 118. Indoor side 116 of exterior wall 110 faces inward toward indoor space 112 and outdoor side 118 of exterior wall 110 faces outward toward outdoor space 114. Although system 100 is described herein with reference to exterior wall 110, it will be appreciated that system 100 is equally applicable to applications where the outdoor unit of system 100 is mounted within an opening of an interior wall.

System 100 includes an indoor unit 130 and an outdoor unit 140. For this embodiment, indoor unit 130 has a casing 132 and is mounted to the indoor side 116 of exterior wall 110. However, in other embodiments, indoor unit 130 can be mounted in other suitable locations within indoor space 112. Indoor unit 130 generally functions as an air handler for conditioning indoor space 112. Outdoor unit 140 is mounted within an opening 120 defined by exterior wall 110. Outdoor unit 140 has a casing or sleeve 142 that encases various operational components and is capped by a sleeve cover 144. In some embodiments, sleeve 142 can be a sleeve of an existing packaged terminal air conditioner (PTAC) mounted within opening 120. In other embodiments, sleeve 142 can be a new sleeve sized to be fit into a predefined opening defined by exterior wall 110.

Sleeve 142 of outdoor unit 140 extends at least partially into outdoor space 114 and extends through opening 120. Sleeve cover 144 is connected to sleeve 142 within indoor space 112. Sleeve 142 can be a plastic lineset cover, for example. In some embodiments, sleeve cover 144 is acoustically rated such that sleeve cover 144 substantially eliminates human-perceivable sound from emanating from outdoor unit 140 into indoor space 112. Further, in some embodiments, sleeve cover 144 is flush with indoor side 116 of exterior wall 110. In yet other embodiments, sleeve cover 144 is substantially flush with indoor side 116 of exterior wall 110, e.g., within one (1) or two (2) inches of being flush with indoor side 116 of exterior wall 110. Sleeve cover 144 is removable from sleeve 142. Thus, to perform a maintenance operation, a maintenance professional can remove sleeve cover 144 from sleeve 142 and can access the operational components within outdoor unit 140 from inside or within indoor space 112.

Indoor unit 130 and outdoor unit 140 are in fluid communication via one or more refrigerant lines. Further, indoor unit 130 and outdoor unit 140 are in electrical communication via one or more electrical lines. The refrigerant lines and electrical lines can be enclosed within a conduit 122, e.g., for protection from outdoor elements. In some embodiments, the refrigerant lines and electrical lines can be enclosed within separate conduits. Furthermore, in some embodiments, conduit 122 can extend from outdoor unit 140 to indoor unit 130 through exterior wall 110, e.g., so that conduit 122 never extends into outdoor space 114. In some embodiments, conduit 122 can extend through indoor space 112, e.g., along indoor side 116 of exterior wall 110. Further, in some embodiments, a drain conduit can be provided to allow for water or water vapor to exit from within casing 132 of indoor unit 130 to outdoor space 114 or another suitable location.

Figure 2:
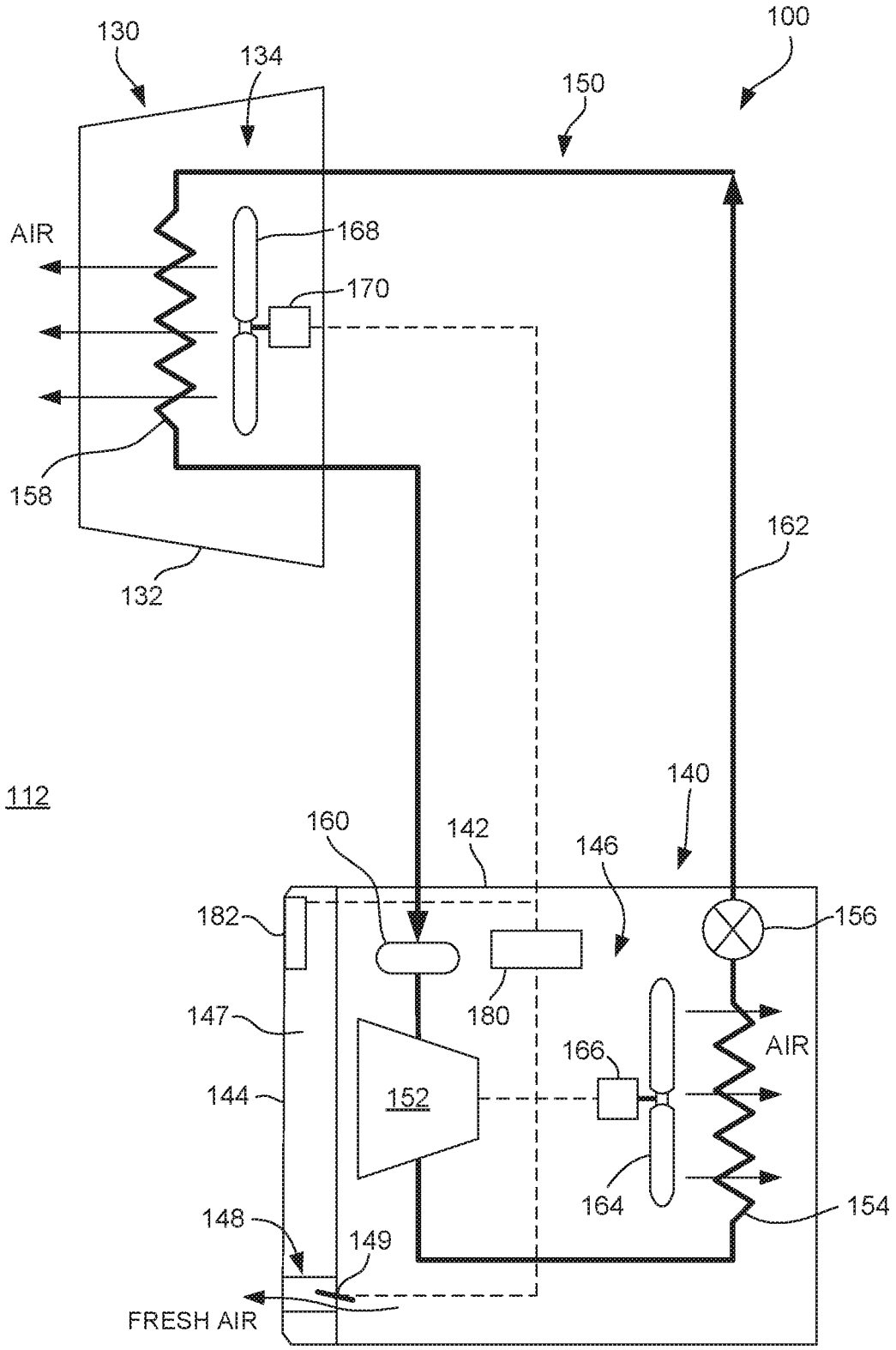
FIG. 2 provides a schematic side view of a sealed system of the air conditioning system of FIG. 1.

FIG. 2 provides a schematic side view of a sealed system 150 of air conditioning system 100. As shown in FIG. 2, sealed system 150 includes various operational components. Sleeve 142 of outdoor unit 140 defines a machinery compartment 146 that contains some of the operational components and a casing 132 of indoor unit 130 defines a machinery compartment 134 that contains some of the operational components. Generally, the operational components are operable to execute a vapor compression cycle for cooling or heating air within indoor space 112. For this embodiment, the operational components of sealed system 150 include a compressor 152, an outdoor coil 154, an expansion device 156, an indoor coil 158, and a reversing valve 160 connected in series along a refrigerant line 162. Refrigerant line 162 is charged with a refrigerant. The operational components of sealed system 150 also include associated fans, including an outdoor fan 164 associated with outdoor coil 154 and an indoor fan 168 associated with indoor coil 158. Outdoor fan 164 is driven by an outdoor motor 166 and indoor fan 168 is driven by an indoor motor 170. Outdoor motor 166 and indoor motor 170 can be constant speed motors and/or variable speed motors.

Sealed system 150 depicted in FIG. 2 is provided by way of example only. Thus, it is within the scope of the present subject matter for other configurations of the sealed system to be used as well. As will be understood by those skilled in the art, sealed system 150 may include additional components, e.g., at least one additional outdoor coil, compressor, expansion device, and/or indoor coil. As an example, sealed system 150 may include two (2) indoor coils.

When air conditioning system 100 is operating in a cooling mode, gaseous refrigerant flows along refrigerant line 162 into compressor 152, which operates to increase the pressure of the refrigerant. Such compression of the refrigerant raises its temperature, which is lowered by passing the gaseous refrigerant through outdoor coil 154. Within outdoor coil 154, heat exchange with ambient air takes place so as to cool the refrigerant and cause the refrigerant to condense to a liquid state. Outdoor fan 164 is used to move air across outdoor coil 154 so as to provide forced convection for a more rapid and efficient heat exchange between the refrigerant within outdoor coil 154 and the ambient air. Ambient air can be moved into outdoor unit 140 via louvers of sleeve 142, for example. As will be understood by those skilled in the art, increasing airflow across outdoor coil 154 can, e.g., increase the efficiency of outdoor coil 154 by improving cooling of the refrigerant contained therein.

An expansion device 156 (e.g., a valve, capillary tube, or other restriction device) receives liquid refrigerant from outdoor coil 154. From expansion device 156, the liquid refrigerant leaves outdoor unit 140 and travels to indoor unit 130 where the liquid refrigerant enters indoor coil 158. Upon exiting expansion device 156 and entering indoor coil 158, the liquid refrigerant drops in pressure and vaporizes. Due to the pressure drop and phase change of the refrigerant, indoor coil 158 is cool relative to indoor space 112. As such, cooled air is produced and indoor space 112 is cooled. Thus, indoor coil 158 is a type of heat exchanger that transfers heat from air passing over indoor coil 158 to refrigerant flowing through indoor coil 158. Indoor fan 168 is positioned within machinery compartment 134 of indoor unit 130. Indoor fan 168 is provided for urging or moving air across indoor coil 158 and cycling air within indoor space 112. The refrigerant leaves indoor coil 158 as vapor refrigerant and travels back to outdoor unit 140 along refrigerant line 162. The vapor refrigerant passes through reversing valve 160 and cycles through refrigerant line 162 as discussed above.

It will be appreciated that reversing valve 160, when commanded to do so, can reverse the flow of refrigerant through refrigerant line 162 of sealed system 150 so that air conditioning system 100 can operate in a heating mode. In this way, system 100 can provide heat to indoor space 112.

Figure 3:
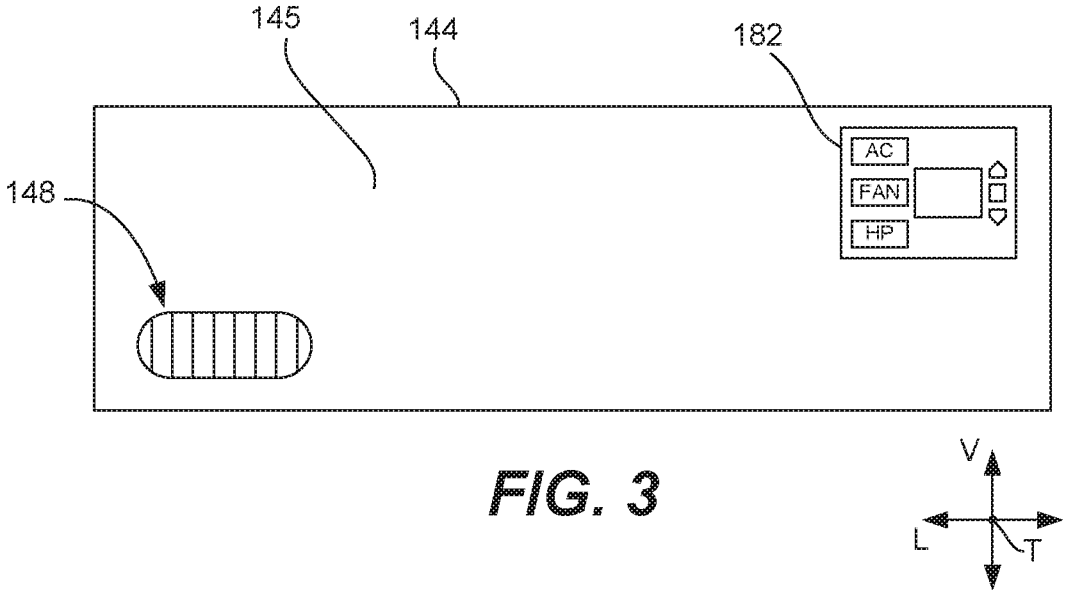
FIG. 3 provides a front view of an example sleeve cover of the air conditioning system of FIG. 1.

With reference now to FIGS. 2 and 3, FIG. 3 provides a front view of sleeve cover 144 of air conditioning system 100. As depicted, sleeve cover 144 defines a fresh air vent 148. Fresh air vent 148 can allow for fresh air to pass through sleeve cover 144 and into indoor space 112. As noted above, ambient or fresh air can be moved into outdoor unit 140 via louvers of sleeve 142, for example. In some embodiments, sleeve cover 144 includes a valve 149 that is movable between an open position (shown in FIG. 2) and a closed position. In the open position, valve 149 allows fresh air to flow through fresh air vent 148 and into indoor space 112. In the closed position, valve 149 prevents or inhibits fresh air from flowing through fresh air vent 148 into indoor space 112. In this way, valve 149 selectively allows fresh air to pass through fresh air vent 148 and into indoor space 112.

As further shown in FIG. 3, sleeve cover 144 defines a vertical direction V, a lateral direction L, and a transverse direction T. Sleeve cover 144 has a front panel 145 and a pair side panels 147 at opposite ends of sleeve cover 144 (one side panel 147 is shown in FIG. 2). Sleeve cover 144 can also include a top panel and a bottom panel in some embodiments. Front panel 145 extends generally in a plane orthogonal to the transverse direction T and side panels 147 extend generally in a plane orthogonal to the lateral direction L. In some embodiments, at least ninety percent (90%) of front panel 145 is solid (i.e., does not contain holes or openings). In some embodiments, at least ninety percent (90%) of sleeve cover 144 is solid, which includes all of the panels of sleeve cover 144. In this way, sound emanating from the operational components within outdoor unit 140 (e.g., compressor 152, outdoor fan 164, outdoor motor 166, etc.) is substantially reduced or eliminated from traveling into indoor space 112. In some embodiments, as noted above, sleeve cover 144 is acoustically rated to substantially eliminate human-perceivable sound from emanating from outdoor unit 140 into indoor space 112.

Returning to FIG. 2, system 100 also includes a controller 180. Controller 180 is operable to control the various operational components of sealed system 150 as well as other controllable devices of system 100. Controller 180 can include one or more processors and one or more memory devices. The processor(s) of controller 180 can be any suitable processing device, such as a microprocessor, microcontroller, integrated circuit, or other suitable processing device. The memory device(s) of controller 180 can include any suitable computing system or media, including, but not limited to, non-transitory computer-readable media, RAM, ROM, hard drives, flash drives, or other memory devices. The memory of controller 180 can store information accessible by processor(s) of controller 180, including instructions that can be executed by processor(s) of controller 180 in order to provide functionality to outdoor unit 140 and indoor unit 130. For instance, controller 180 can execute one or more software applications or control logic for certain functionality operations, e.g., causing indoor fan 168 to move air across indoor coil 158 and/or causing outdoor fan 164 to move air across outdoor coil 154. Controller 180 can also include a network interface, e.g., for facilitating communications between system 100 and other connected devices via a network. The network interface of controller 180 can include suitable hardware for interfacing with one or more wireless networks, such as Wi-Fi networks generally (IEEE 802.11 networks), ZigBee (IEEE 802.15-4), Bluetooth Low Energy (LE), and Bluetooth Mesh. Additionally or alternatively, in some embodiments, the network interface of controller 180 can include hardware and/or input/output ports for connecting with a network over a wired communication link. Network interface can include any suitable components for interfacing with network and/or user devices. For example, the network interface can include transmitters, receivers, ports, antennas, or other suitable components for interfacing with network and/or user devices.

Controller 180 is communicatively coupled with various components of system 100. For instance, as shown in FIG. 2, controller 180 is communicatively coupled with compressor 152, outdoor motor 166, indoor motor 170, and a user interface 182 positioned along sleeve cover 144. Controller 180 can receive data from the various devices and can send data, e.g., control commands to the various operational devices. Based on one or more user inputs to user interface 182, controller 180 can output one or more control commands to one or more of the coupled devices. By way of example, controller 180 can send control commands to outdoor motor 166 to control the speed of outdoor fan 164 and/or send control commands to indoor motor 170 to control the speed of indoor fan 168 and/or send control commands to compressor 152, e.g., to start a duty cycle.

Figure 4:
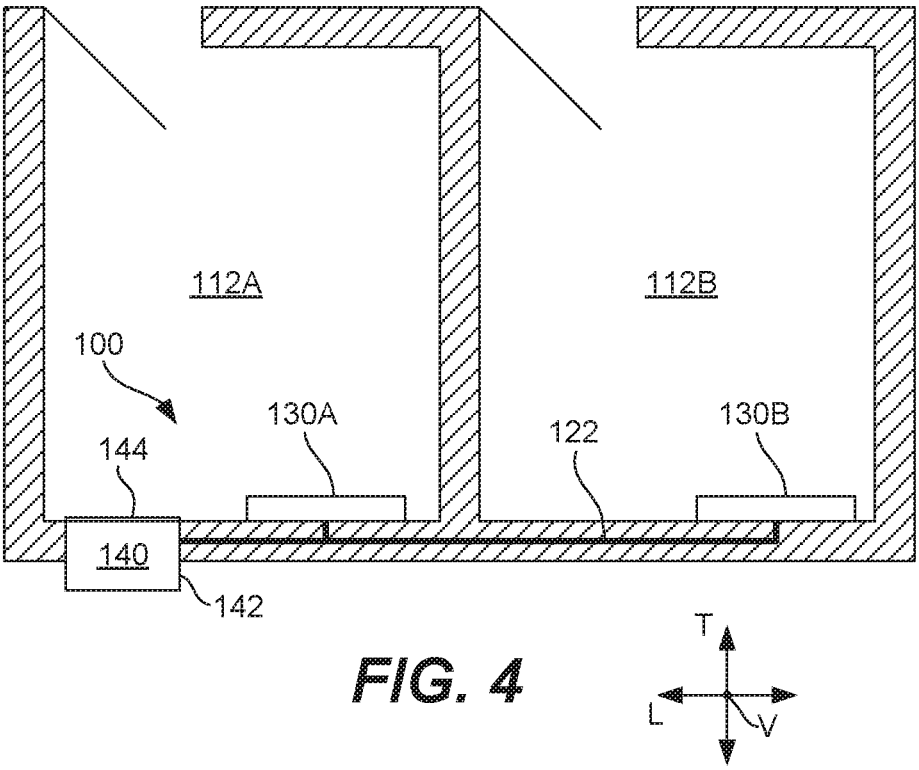
FIG. 4 provides a top plan view of an example building having an air conditioning system having a single outdoor unit fluidly coupled with multiple indoor units according to exemplary embodiments of the present disclosure.

In some embodiments, multiple indoor units can be fluidly coupled with a single outdoor unit. For instance, FIG. 4 provides a top plan view of an example building having an air conditioning system 100 that includes a single outdoor unit 140 and multiple indoor units, including a first indoor unit 130A for conditioning a first space 112A and a second indoor unit 130B for conditioning a second space 112B. First indoor unit 130A and second indoor unit 130B can be similarly configured as indoor unit 130 described herein. Particularly, first indoor unit 130A can include an indoor coil, an indoor fan, and an indoor motor for driving the indoor fan. The indoor fan of first indoor unit 130A can move air over the indoor coil of first indoor unit 130A, e.g., for conditioning first space 112A. Similarly, second indoor unit 130B can include an indoor coil, an indoor fan, and an indoor motor for driving the indoor fan. The indoor fan of second indoor unit 130B can move air over the indoor coil of second indoor unit 130B, e.g., for conditioning second space 112B. Outdoor unit 140 of FIG. 4 can be similarly configured as outdoor unit 140 described herein.

Notably, the outdoor coil of outdoor unit 140 is in fluid communication with the indoor coil of first indoor unit 130A and the indoor coil of second indoor unit 130B. Accordingly, in some embodiments, a single PTAC revamped as outdoor unit 140 can be fluidly coupled with multiple indoor split-system units embodied as first indoor unit 130A and second indoor unit 130B, and thus, the revamped outdoor unit 130B can be associated with providing comfort to multiple spaces, such as first space 112A and second space 112B.

With system 100 and alternative embodiments thereof described, advantages and benefits thereof will be provided with reference to FIGS. 1 through 4. In one aspect, outdoor unit 140 (which may utilize the sleeve and outdoor sealed system components of a previously operational self-contained PTAC) is accessible from indoor space 112, e.g., for maintenance purposes. As noted previously, outdoor units of conventional split-systems are located entirely outside and do not extend through an opening defined by an exterior wall as do PTACs. Thus, in leveraging an existing PTAC to act as the outdoor unit of the air conditioning system, indoor access to outdoor unit 140 is achievable, which can greatly reduce maintenance times, among other potential benefits.

In another aspect, sleeve cover 144 has a smaller transverse length than the removed front cover of the existing PTAC such that when sleeve cover 144 is connected to sleeve 142, sleeve cover 144 protrudes less far into indoor space 112 than did the front cover. Accordingly, with the upgraded air conditioning system, the outdoor unit (previously the self-contained PTAC) is made more compact and thus protrudes less far into indoor space 112.

In yet another aspect, air conditioning system 100 can operate more quietly than conventional PTACs. As noted above, in some embodiments, sleeve cover 144 is acoustically rated to substantially eliminate human-perceivable sound from emanating from outdoor unit 140 into indoor space 112. Thus, the amount of noise emanating into the conditioned space from outdoor unit 140 can be reduced. Further, advantageously, indoor unit 130 can condition the air within the designated space quieter than conventional PTACs.

In a further aspect, in upgrading an existing PTAC to the outdoor unit 140, the opening 120 defined by exterior wall 110 in which the existing PTAC is located need not be plugged, sealed, or otherwise filled in as outdoor unit 140 utilizes the existing PTAC sleeve 142 and outdoor sealed system components (e.g., outdoor coil 154, outdoor fan 164, outdoor motor 166, etc.). Furthermore, by utilizing components of an existing PTAC, outdoor unit 140 of air conditioning system 100 may be less of an eye sore as sleeve 140 protruding into outdoor space 114 is generally more aesthetically pleasing than fully-exterior outdoor units of conventional split-system air conditioners. Moreover, the outdoor unit need not be placed on the roof or in some other hard to access location. It will be appreciated that system 100 described herein may have other benefits and advantages not explicitly listed herein.

Figure 5:
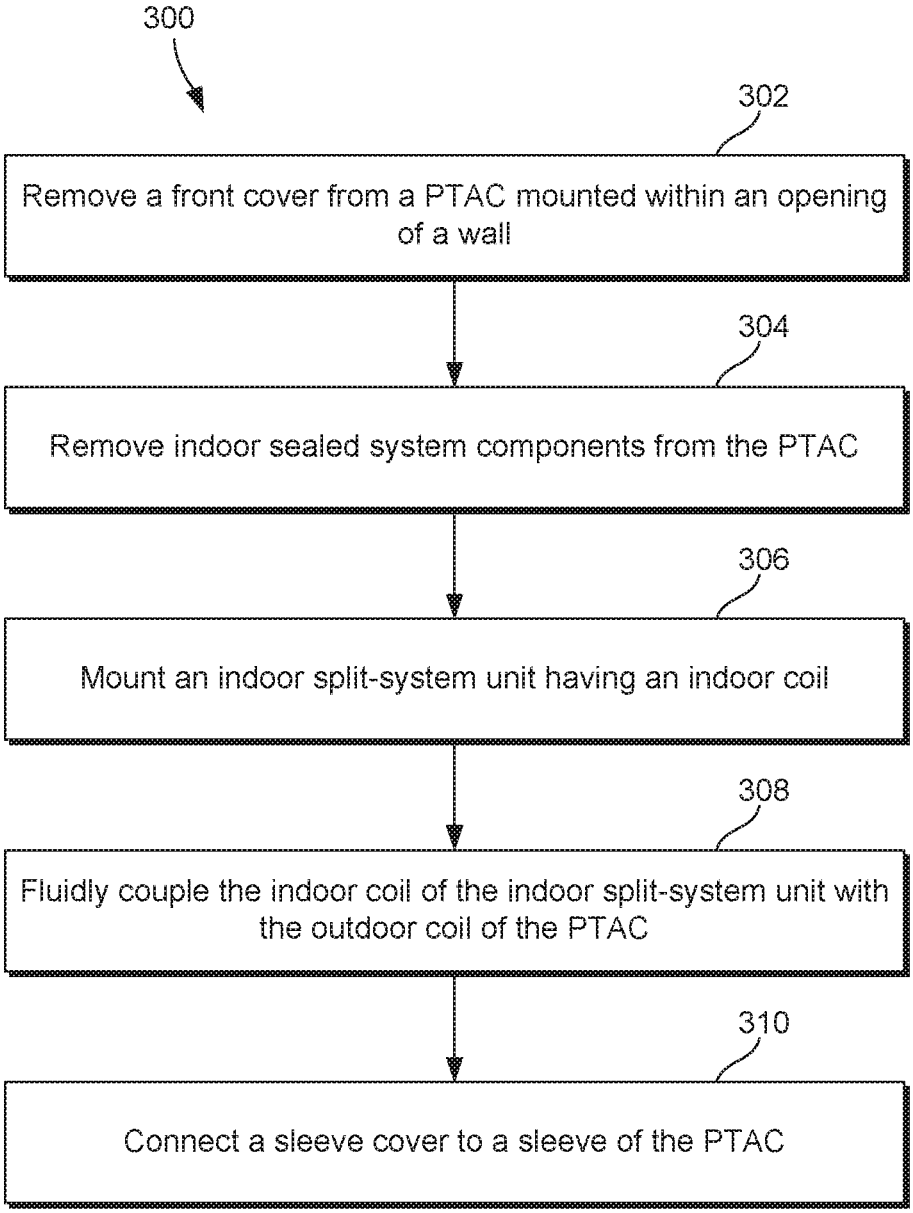
FIG. 5 provides a flow diagram of a method of installing an air conditioning system according to exemplary embodiments of the present disclosure.

FIG. 5 provides a flow diagram of an example method (300) of installing an air conditioning system. For instance, the air conditioning system 100 described herein can be installed as set forth in method (300). The method (300) is particularly useful for upgrading an air conditioning system of an apartment, condominium, or hotel room, among many potential applications, that utilizes or utilized a PTAC (e.g., a self-contained air-conditioning unit positioned within an opening in a wall). FIG. 5 depicts steps performed in a particular order for purposes of illustration and discussion. Those of ordinary skill in the art, using the disclosures provided herein, will understand that various steps of any of the methods disclosed herein can be modified in various ways without deviating from the scope of the present disclosure.

At (302), the method (300) includes removing a front cover from a PTAC mounted within an opening of a wall. The PTAC can be an existing unit of an apartment, condominium, hotel room, among other potential indoor spaces. The PTAC can be a self-contained air conditioning unit that can operate in one or both of a cooling mode and a heating mode for conditioning the air within a designated space. The front cover of the existing PTAC is removed so that an installation professional or other user can access the machinery compartment of the PTAC. In this way, as will be explained below at (304), the installation professional or other user can remove the indoor operational components of the sealed system of the PTAC.

At (304), the method (300) includes removing the indoor sealed system components from the PTAC. In some implementations, removing the indoor sealed system components from the PTAC includes removing the indoor coil from the PTAC. In yet other implementations, removing the indoor sealed system components from the PTAC includes removing the indoor coil and the indoor fan (and associated indoor fan motor) from the PTAC. In most conventional PTACs, the indoor coil and the indoor fan and associated fan motor are located toward the front or indoor end of the unit. Accordingly, an installation professional can readily remove the indoor sealed system components from the PTAC. It will be appreciated that care should be taken with respect to the refrigerant within the refrigerant line when removing the indoor coil from the PTAC.

At (306), the method (300) includes mounting and indoor split-system unit having an indoor coil. For instance, the indoor split-system unit can be indoor unit 130 described herein. The indoor split-system unit can be mounted to an exterior wall (e.g., as shown in FIG. 1), an interior wall, a ceiling, or a floor defining the space to be conditioned. The indoor split-system unit can also include an indoor fan and associated indoor fan motor for driving the indoor fan. The indoor fan of the indoor split-system unit can move air across the indoor coil during operation.

At (308), the method (300) includes fluidly coupling the indoor coil of the indoor split-system unit with the outdoor coil of the PTAC. Stated another way, the indoor coil of the indoor unit is fluidly coupled with the outdoor coil of the outdoor unit mounted within the opening of a wall. For instance, the refrigerant line or lines of the existing PTAC or outdoor unit can be connected with the refrigerant line or lines of the mounted indoor split-system unit. As a result, a sealed system is formed between the outdoor existing PTAC and the indoor split-system unit. For example, the example embodiment of FIG. 2 depicts the formed sealed system as a result of fluidly coupling the indoor coil of the indoor split-system unit with the outdoor coil of the PTAC. As shown, indoor coil 158 of indoor unit 130 is fluidly coupled with outdoor coil 154 of outdoor unit 140, forming sealed system 150. Effectively, the indoor split-system unit replaces the indoor sealed system components of the PTAC. The indoor split-system unit is operable to condition the space and the PTAC is no longer a self-contained unit. The fluidly coupled refrigerant lines spanning between the indoor split-system unit and the outdoor PTAC can be secured in one or more conduits, e.g., as shown in FIG. 1.

In some implementations, the method (300) includes electrically coupling the indoor split-system unit with the outdoor PTAC. In this way, the indoor split-system unit can operate in harmony with the PTAC. Further, when the indoor split-system unit is electrically coupled with the PTAC, the indoor split-system unit can be controlled by a controller of the PTAC, or vice versa. For instance, with reference to FIG. 2, controller 180 of the PTAC or outdoor unit 140 can be used to control various operational components of the indoor split-system unit or indoor unit 130, such as indoor motor 170 that can ultimately be used to control the rate of heat transfer between the air and refrigerant via indoor fan 168.

At (310), the method (300) includes connecting a sleeve cover to a sleeve of the PTAC. For instance, the sleeve cover can be sleeve cover 144 and the sleeve can be sleeve 142 described herein. The sleeve can be an existing sleeve of the PTAC and the sleeve cover can be fit over or connected to the existing sleeve to encase the operational components of the outdoor unit of the system. In some implementations, the sleeve cover is acoustically rated to substantially eliminate human-perceivable sound from emanating from the outdoor unit (previously the self-contained PTAC) into the air-conditioned space. Thus, the amount of noise emanating into the conditioned space from the outdoor unit can be reduced. Further, advantageously, the indoor split-system unit can condition the air within the designated space quieter than the exiting PTAC.

Furthermore, in some implementations, the sleeve cover has a smaller transverse length than the removed front cover such that when the sleeve cover is connected to the sleeve, the sleeve cover and thus the outdoor unit protrudes less far into the conditioned space (e.g., hotel room) than did the front cover when it was connected to the sleeve. Accordingly, with the upgraded air conditioning system, the outdoor unit (previously the self-contained PTAC) is made more compact and thus protrudes less far into the conditioned space. The outdoor unit can be made more compact due to the removal of the indoor sealed system components and the sleeve cover having a smaller transverse length than the front cover. Advantageously, this may increase the usable space within the conditioned space or room.

One further advantage of upgrading the air conditioning system as described above is that the outdoor unit (previously the self-contained PTAC) is accessible (e.g., for maintenance) from indoors or from within the conditioned space. As noted previously, outdoor units of conventional split-systems are located entirely outside; they do not extend through an opening defined by an exterior wall as do PTACs. Thus, in leveraging an existing PTAC to act as the outdoor unit of the air conditioning system, indoor access to the outdoor unit of the air conditioning system described herein is achievable, which can greatly reduce maintenance times, among other potential benefits.

In addition, if it is desired to upgrade an existing PTAC to the air conditioning system described herein, the opening defined by the wall in which the PTAC is located need not be plugged, sealed, or otherwise filled in as the air conditioning system described herein utilizes the existing PTAC sleeve and outdoor sealed system components. Furthermore, in utilizing components of an existing PTAC, the outdoor unit of the air conditioning system is less of an eye sore as the sleeve of a PTAC unit protruding into an outdoor space is generally more aesthetically pleasing than fully-exterior outdoor units of conventional split-system air conditioners. Moreover, the outdoor unit need not be placed on the roof or in some other hard to access location.

Although specific features of various embodiments may be shown in some drawings and not in others, this is for convenience only. In accordance with the principles of the present disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioning system, comprising:

an indoor unit operable to move conditioned air into a space, the indoor unit having an indoor coil; and an outdoor unit physically separated from the indoor unit, the outdoor unit being mounted within an opening defined by an exterior wall and extending at least partially into the space and at least partially into an outdoor space, the outdoor unit having an outdoor coil in fluid communication with the indoor coil of the indoor unit, the outdoor unit further having a sleeve capped by a sleeve cover, the sleeve cover having a control panel for controlling operation of the air conditioning system.

2. The air conditioning system of claim 1, wherein the indoor unit has an indoor fan operable to move air over the indoor coil and into the space.

3. The air conditioning system of claim 1, wherein the outdoor unit has an outdoor fan operable to move air over the outdoor coil.

4. The air conditioning system of claim 1, wherein the outdoor unit has a reversing valve, a compressor, and an expansion valve, and wherein the indoor coil of the indoor unit is serially fluidly connected with the reversing valve, the compressor, the outdoor coil, and the expansion valve.

5. The air conditioning system of claim 1, wherein the sleeve cover is acoustically rated to substantially eliminate sound from emanating from the outdoor unit into the indoor space.

6. The air conditioning system of claim 5, wherein the sleeve cover includes a fresh air vent for selectively allowing fresh air to enter the indoor space.

7. The air conditioning system of claim 1, wherein the outdoor unit is accessible from the indoor side of the exterior wall.

8. The air conditioning system of claim 1, wherein the outdoor unit has a sleeve capped by a sleeve cover, and wherein the sleeve cover is substantially flush with the indoor side of the exterior wall.

9. The air conditioning system of claim 8, wherein the sleeve of the outdoor unit is from an existing packaged terminal air conditioner.

10. The air conditioning system of claim 1, further comprising:

a second indoor unit having an indoor coil and indoor fan for moving air over the indoor coil, and wherein the outdoor coil of the outdoor unit is in fluid communication with the indoor coil of the second indoor unit.

11. A method of installing an air conditioning system, comprising:

fluidly coupling an indoor coil of an indoor unit operable to condition a space with an outdoor coil of an outdoor unit mounted within an opening of a wall;

removing a front cover the outdoor unit; and after fluidly coupling the indoor coil of the indoor unit operable to condition the space with and the outdoor coil of the outdoor unit mounted within the opening of the wall, connecting a sleeve cover to a sleeve of the outdoor unit so that the sleeve cover protrudes less into the space than did the front cover when the front cover was connected to the sleeve.

12. The method of claim 11, further comprising:

removing an indoor coil from the outdoor unit.

13. The method of claim 11, further comprising:

mounting the indoor unit to a wall defining the space, the indoor unit having the indoor coil and a fan for moving air over the indoor coil.

14. The method of claim 11, wherein the sleeve cover is acoustically rated to substantially eliminate sound from emanating from the outdoor unit into the indoor space.

15. The method of claim 11, wherein at least ninety percent of the sleeve cover is solid.

16. An air conditioning system, comprising:

a sealed system having a refrigerant line;

an indoor unit operable to move conditioned air into an indoor space, the indoor unit being mounted entirely within the indoor space and having an indoor coil positioned along the refrigerant line; and an outdoor unit physically separated from the indoor unit, the outdoor unit being mounted within an opening defined by an exterior wall at least partially enclosing the indoor space, the outdoor unit extending at least partially into an outdoor space and at least partially into the indoor space, the outdoor unit having an outdoor coil positioned along the refrigerant line, the outdoor unit further having a sleeve capped by a sleeve cover, and wherein the sleeve cover has a fresh air vent for selectively allowing fresh air to enter the indoor space.

17. The air conditioning system of claim 16, wherein the indoor unit is mounted to an indoor side of the exterior wall above the outdoor unit along a vertical direction.

* * * * *